United States Patent [19]

Queener

[11] Patent Number: 4,609,280

[45] Date of Patent: Sep. 2, 1986

[54] XEROGRAPHIC APPARATUS AND PROCESS WITH BACKSIDE PHOTOCONDUCTOR IMAGING

[75] Inventor: Carl A. Queener, Lyons, Colo.

[73] Assignee: International Business Machines Corporation, Armonk, N.Y.

[21] Appl. No.: 547,546

[22] Filed: Oct. 31, 1983

[51] Int. Cl.[4] ..... G03G 15/00

[52] U.S. Cl. ..... 355/3 DD; 355/15; 355/16; 355/77

[58] Field of Search ..... 355/3 R, 3 BE, 16, 77, 355/15, 3 DD; 430/31, 125

[56] References Cited

U.S. PATENT DOCUMENTS

| | | | |
|---|---|---|---|
| 2,968,552 | 1/1961 | Gundlach | 355/3 R |
| 3,168,022 | 2/1965 | Limberger | 430/31 X |
| 3,335,003 | 8/1967 | Snelling | 430/31 X |
| 3,647,293 | 3/1972 | Queener | 355/15 |
| 3,649,262 | 3/1972 | Cade et al. | 96/1.4 |
| 3,700,328 | 10/1972 | Davidge et al. | 355/3 DD |
| 3,838,921 | 10/1974 | Sargis | 355/15 |
| 3,936,181 | 2/1976 | Hill | 355/14 |
| 4,110,026 | 8/1978 | Farley et al. | 355/16 X |
| 4,141,648 | 2/1979 | Gaitten et al. | 355/15 X |
| 4,142,165 | 2/1979 | Miyakawa et al. | 355/15 X |
| 4,322,734 | 3/1982 | Ebi et al. | 346/153.1 |
| 4,357,096 | 11/1982 | Fetterman | 355/3 |
| 4,372,669 | 2/1983 | Fantuzzo | 355/3 |

*Primary Examiner*—R. L. Moses

*Attorney, Agent, or Firm*—Earl C. Hancock

[57] ABSTRACT

A closed-loop photoconductor belt capable of transmitting light from its inner surface to a photoconductive layer is imaged on the internal surface after charging of the photoconductive layer. A developer transfers toner to the image area on the external surface of the belt, while scavenging residual toner from the belt external surface. The image representing toner is transferred from the external belt surface to a copy medium at a transfer station. A back-lighting erase lamp and biased AC pretransfer corona improve transfer efficiency and suppress background transfer during the transfer operation, respectively.

6 Claims, 3 Drawing Figures

XEROGRAPHIC APPARATUS AND PROCESS WITH BACKSIDE PHOTOCONDUCTOR IMAGING

BACKGROUND OF THE INVENTION

1. Field of the Invention

The present invention relates generally to xerographic or electrophotographic copiers, printers, and the like, and particularly to methods and apparatus for selective discharge of a charged photoconductor to form a developable latent image for transfer to a copy sheet which is ultimately processed to produce a visible copy of the image. The present invention makes it possible to obtain the economical advantages of two-cycle xerographic processing with the operating speed of a single-cycle electrophotographic process.

2. Description of the Prior Art

Contemporary electrophotographic products are broadly characterized in general as either single-cycle machines or two-cycle machines. A typical single-cycle machine charges a photoconductor belt or drum, selectively discharges areas of that photoconductor to conform to a desired image, develops the image, as by application of toner, transfers the image to a copy sheet, discharges the photoconductor, and subsequently cleans the photoconductor with a cleaning station separate from the developer unit. Single-cycle machines operate over a wide range of operating speeds.

Unfortunately, the single-cycle machines suffer from the disadvantage of additional cost associated with single-function elements, such as a separate cleaning station. In addition, the separate cleaning station has also contributed a significant cost factor for servicing and maintenance of that equipment. For instance, cleaning brushes, filters, toner return augers, and the like, require servicing and changing or replacement at relatively frequent intervals, and thus place a significant operating cost on the machine owner.

Two-cycle machines use dual functions for each of several components associated with the electrophotographic processing. A prime example is shown in U.S. Pat. No. 3,647,293, entitled "Copying System Featuring Combined Developing/Cleaning Station Alternately Activated" by Carl A. Queener filed December 1, 1970, wherein shared function components are disclosed including a combined developer/cleaner alternately operable to provide those functions during separate cycles associated with the photoconductor.

While two-cycle machines do not require conventional xerographic cleaning stations and thus avoid the expenses associated therewith, a price is paid in throughput in that a separate cleaning cycle is executed each time the page printed or copied is changed. In a machine, such as a copier/duplicator using a recirculating document feeder or a laser or light-emitting diode xerographic printer that prints collated sets, the page printed or copied is changed every time, thus cutting the throughput in half for a given xerographic process speed or alternately doubling the process speed to maintain a given throughput.

Some prior art devices include interior lamps to illuminate the photoconductor belt and to assist in the discharge of the photoconductor in aid of cleaning. Such a system is shown in U.S. Pat. No. 4,372,669 by J. Fantuzzo et al. filed June 29, 1981, which utilizes a cleaning augmentation lamp within a photoconductor belt in a two-cycle machine environment. U.S. Pat. No. 4,322,734 by Y. Ebi et al. filed November 8, 1979, shows a similar arrangement wherein an internally located lamp illuminates a photoconductor belt, which has a transparent interior layer, with an intermediate photoconductor layer. The Ebi et al. device controls the intensity of the lamp for the purpose of maintaining relatively uniform copy density associated with an electrode discharge imaging assembly.

A photoelectrophoretic migration imaging system using an internally located imaging means, such as a laser which illuminates a transparent drum, is shown in U.S. Pat. No. 4,357,096 by C. L. Fetterman filed March 6, 1981. The Fetterman device sprays electrophotosensitive pigment onto the transparent drum exterior. At the imaging zone, illuminated portions from the interior source are caused to migrate to an appropriate one of either the transparent drum or a tangentially engaging drum with the portions so migrating originating from the pigment supply spray. The Fetterman device is essentially a single-cycle configuration in that a separate pigment cleaning station is employed.

None of the known prior art obtains the advantages of avoiding use of a separate cleaning station associated with a two-cycle machine while enjoying the operating speed of a single-cycle machine. This result is obtained by the present invention.

DISCLOSURE OF THE INVENTION

The present invention relates to a xerographic or electrophotographic type of machine which has a photoconductor belt mounted for continuous movement in a closed loop, and wherein this belt includes a chargeable photosensitive layer and an image-transmitting layer on the inner side of the photosensitive layer. Such machines include an arrangement for electrostatically charging the photoconductor belt and means for feeding copy sheets or other media past the image transfer station relative to the outer surface of the photoconductor belt. The improvement in accordance with this invention involves inclusion of a device for directing an image onto the inner surface of the electrostatically charged photoconductor belt. The belt then encounters an arrangement for applying toner to the external surface of the image bearing photoconductor belt, and which further provides scavenging of the residual toner associated with the image from the photoconductor belt external surface. The scavenging function is augmented by an arrangement for discharging the belt which is located between the toner applying/scavenging arrangement and the image transfer station.

In one form, the belt discharging arrangement is provided by an erase lamp positioned for directing light against the interior surface of the belt between the developer/cleaner and the image transfer station.

While the invention described below is illustrated in the environment of a xerographic printer, the invention is equally suitable for use in a xerographic copier or duplicator environment or a combination of a copier and printer device. Those having normal skill in the art will readily recognize the foregoing and other objects, features, advantages, and applications of the present invention in the light of the following more detailed description of the exemplary preferred embodiments as illustrated in the accompanying drawings.

DETAILED DESCRIPTION OF THE PREFERRED EMBODIMENTS

The preferred embodiments achieve a xerographic process that eliminate the need for a cleaning station without a consequent loss in throughput. Broadly, the present invention is a xerographic process wherein imaging or exposure is accomplished on the reverse side of the photoconductor through a transparent or semi-transparent ground plane thereby allowing simultaneous accomplishment of the cleaning and developing steps of xerography by a conventional xerographic developing apparatus without a loss in throughput for a given process speed. The exemplary preferred embodiments described are in terms of a xerographic printer, although the invention is equally suited to copier/duplicators or devices with a combination of both printer and copier functions.

Figure 1:
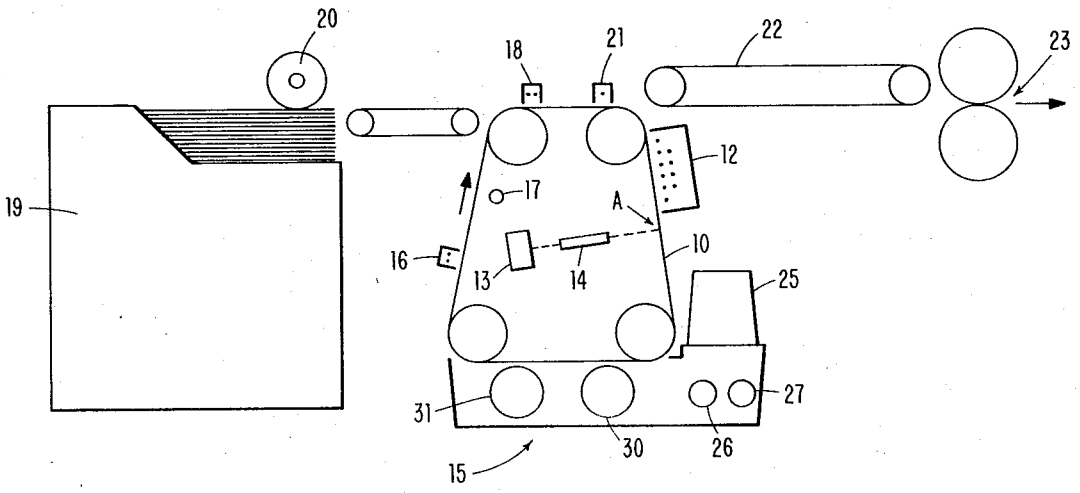
FIG. 1 is a diagram of a xerographic printer arrangement particularly suited for using dry toner.

FIG. 1 shows a machine operable in accordance with the present invention for use with a dry toner-type developer/cleaner. Photoconductor belt 10 is charged by a corona 12 as the belt 10 passes beneath corona 12. Belt 10 is conventional except that the photoconductor is placed on a transparent substrate, such as an optical grade of Mylar which is relatively clear and free of blemishes and defects. The ground plane adjacent to the Mylar is transparent or semi-transparent. A transparent or semi-transparent ground plane is achievable by various processes, such as by thin coating of vacuum-deposited aluminum or other transparent or semi-transparent conductor material.

Imaging of the photoconductor is accomplished by focusing light from a full-width light-emitting diode (LED) array 13 by means of a full-width SELFOC array 14 onto the backside of photoconductor belt 10 at point A in the charge generation layer. The image is formed in a pel-by-pel manner to produce a latent electrostatic image of the information for printing. Laser printing is likewise suitable, and the imaging arrangement can include mirrors and other suitable optical elements for scanning documents in a copier-type operation, if desired.

Conventional magnetic brush developer apparatus 15 develops the latent electrostatic image just written while simultaneously cleaning residual or nontransferred toner present on photoconductor belt 10 on the outer surface thereof from the preceding cycle which had printed a different page of information. This cleaning of the untransferred toner from the previous page of the printed information is possible because of the backside photoconductor imaging from source 13 which erases the electrical charges holding the untransferred toner on the photoconductor. In this example, it is arbitrarily assumed that discharged area development is used wherein characters are written with light instead of writing the background with light. The process is equally suitable for oppositely charged area development.

Corona 16 is a biased pretransfer AC corona to suppress background transfer during the subsequent transfer step and is also conventional. Fluorescent lamp 17 is a back-lighting erase lamp to improve transfer efficiency. The toned image is transferred by the transfer corona 18 to a sheet of plain paper picked from paper supply drawer or bin 19 by a shingler mechanism 20 or the like. Paper supply bin 19 and shingler pick mechanism 20 are similar to those used in the IBM Series III, Models 30/40 Copiers.

Detach corona 21 aids in separation of the copy sheet from photoconductor belt 10. Corona 21 is pulsed with AC voltage for a brief period when the leading edge of the output sheet arrives under corona 21. This causes the leading edge of the output sheet to detach from photoconductor belt 10 at which point it is gripped by vacuum transport belt assembly 22. Assembly 22 transports the output sheet through hot roll fuser assembly 23 to produce the finished page. Note that transport 22 retains the copy sheet on its lower surface so that there is no disturbance of the toner image contained on the downward facing surface of the copy sheet as it is introduced into fuser assembly 23.

A toner supply is contained in a reservoir 25 and periodically metered into the sump of developer/cleaner 15. Augers 26 and 27 recirculate the toner within the sump. Magnetic brush roller 30 is biased to perform the primary cleaning function, such as by setting its bias from zero to a positive voltage level. Magnetic brush roller 31 is biased, such as with a negative voltage bias, to provide the primary toner developing function relative to the photoconductor 10.

The arrangements for continuously driving the closed loop photoconductor belt 10 are conventional as are the controls for ensuring that the area of the image panel, created on photoconductor 10 by imaging device 13, is synchronized with the arrival of the copy sheet from storage bin or supply bin 19. Corona 12 is shown as a multiple wire, gridded corona configuration.

Figure 2:
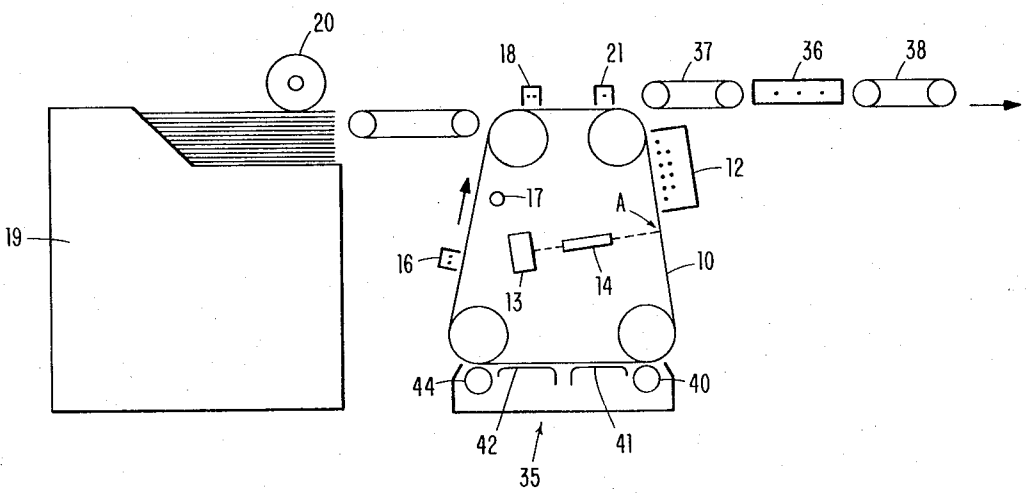
FIG. 2 is a drawing showing the adaptation of the present invention to a liquid developer apparatus.

FIG. 2 shows a machine which includes some components that operate similarly to those in FIG. 1, and these commonly-operating components are referenced with the same reference numerals as FIG. 1. The operation of the FIG. 2 machine is essentially the same as FIG. 1, except the dry toner magnetic brush developing apparatus 15 of FIG. 1 is replaced with a fountain-type liquid developing apparatus 35 somewhat like those in contemporary liquid toner transfer machines. Additionally, hot roll fuser assembly 23 of FIG. 1 is replaced with a heated platen-type drying apparatus 36 located intermediate of vacuum transports 37 and 38. Heated platen 36 heats the output sheet by conduction from the reverse side as is typical in state-of-the-art liquid toner transfer xerographic machines.

In contrast to conventional liquid developers, fountain-type liquid developer 35 includes a rotating foam roll wiper 40 on the entry side of the housing for developer 35. Developer 35 further contains a development electrode arrangement 41 and 42, with a conventional squeegee roller 44 at the exit.

Figure 3:
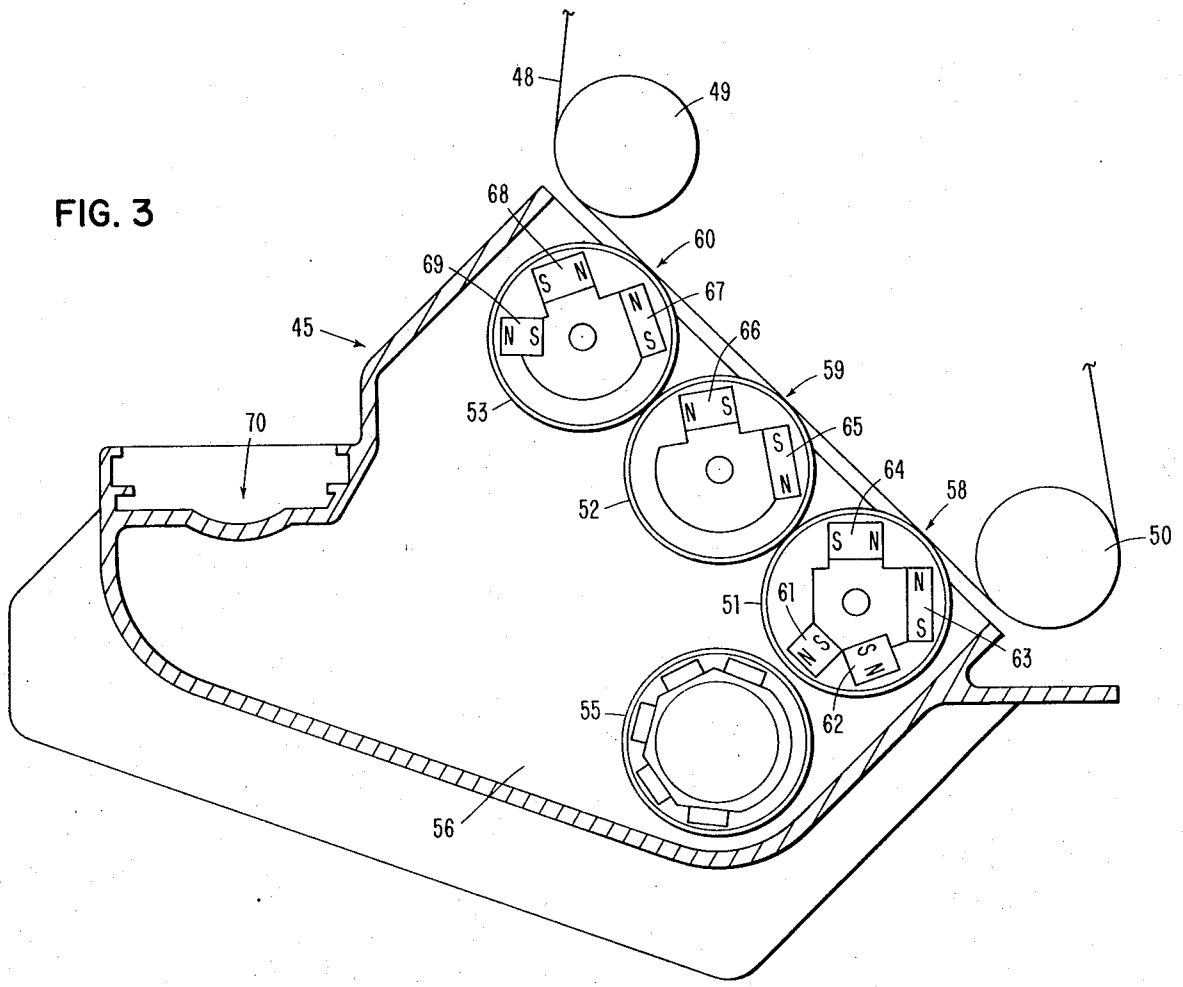
FIG. 3 is an example of a developer/cleaner station for dry toner suitable for use in conjunction with the present invention.

Another developer/cleaner configuration suitable for use in an environment similar to that previously discussed for FIG. 1 is shown in FIG. 3. In this arrangement, closed-loop photoconductor belt 48 is arranged to pass over rollers 49 and 50 so as to interface with magnetic brush rollers 51, 52 and 53 as shown. The three roll magnetic brush developers 51–53 have an internal opposing pole magnet configuration as indicated for each of those rollers. An additional magnetic roller 55 conveys the magnetic carrier from a gravity discharge reservoir 56 to the first magnetic brush roller 51. This carrier or developer mix is transferred from roller 51 to roller 52 and thence to roller 53 before return to sump 56 of the developer not used in the developing function.

The magnetic configuration shown provides good carrier action in the development zones 58, 59 and 60, while concurrently forming part of an integral magnetic circuit linking all three rollers 51–53 together.

The stationary magnetic configuration contained within roller 51 includes an initial magnetic element 61 to transfer the carrier stream from conveyor roller 55 onto the rotating surface of roller 51. Magnet 62 transports the carrier stream to magnets 63 and 64 which have opposing north poles located at the first development zone 58. The chaining action of magnetic carrier beads in a magnetic field is temporarily destroyed causing a turbulence within development zone 58. This enhances development as the carrier stream exits a first development zone 58. Magnet 64 transports the carrier to roller 52 where magnet 65 transports it to development zone 59. In development zone 59, a similar action takes place where the opposing poles cause a turbulence within the development zone, and additional toner is deposited onto photoconductor 48 or the loose toner is brushed from photoconductor 48.

Magnet 66 transports the carrier stream to roller 53 where magnet 67 captures the stream from roller 52 and transports it to development zone 60. In development zone 60, a similar action takes place to that in development zones 58 and 59. Magnets 68 and 69 are used to scavenge the stream and direct it into the sump reservoir 56. Raw toner is added through a replenisher located vertically over the reservoir at inlet 70. The raw toner is mixed with the carrier to form the developer mix.

Developer/cleaner 45 thereby establishes a magnetic circuit with excellent developer turbulence in the development/cleaner zones, while providing good carrier flow and transfer between rollers 51–53. The configuration allows a volume equal to approximately 28 pounds of 200 micron carrier beads. Developer 45 is insensitive to gap spacing, and requires little or no adjustment. The developer 45 is capable of producing 1.4 optical density (density of bulk toner) while maintaining low background of less than 0.5 percent.

In a typical implementation of the FIG. 3 developer/-cleaner for a FIG. 1 type environment, rollers 51 and 52 are biased for cleaning (i.e., zero to a positive bias), whereas roller 53 is biased for developing (i.e., a negative bias). This arrangement performed satisfactorily for up to 50 pages per minute of printing operations. It is possible to include greater numbers of cleaning and/or developing biased rolls within a developer/cleaner 45.

The present invention is not restricted to the specific examples of the preferred embodiments shown and described. Based upon the teachings herein, numerous other implementations and embodiments of this invention will occur to those skilled in the art. For instance, LED array printheads, laser/faceted mirror printheads, or the like are suitable. The invention is equally applicable to dual component dry toner, liquid toner or monocomponent dry toner. As mentioned, xerographic copier imaging, in place of or in conjunction with the printhead arrangement shown, is possible. Although the foregoing describes the exemplary preferred embodiments in relatively specific detail, those having normal skill in the art will recognize various changes, modifications, additions, and applications other than those specifically mentioned herein without departing from the spirit of this invention.

What is claimed is:

1. In an electrophotostatic imaging machine having a photoconductor mounted for movement in a closed loop wherein said photoconductor includes a chargeable photosensitive layer and an image transmitting layer on an inner side of said photosensitive layer, means for electrostatically charging said photoconductor, and means for feeding copy medium past an image transfer station relative to the outer surface of said photoconductor, an improvement comprising:

means for imposing an image onto the inner surface of said electrostatically charged photoconductor;

means for applying toner to an external surface of said image bearing photoconductor and including means for scavenging toner disassociated with the image from said photoconductor outer surface; and means biasing said toner applying and scaverging means for concurrently depositing toner on imaged areas of said photoconductor and attracting toner from nonimaged areas of said photoconductor.

2. An improved machine in accordance with claim 1 which includes photoconductor discharging erase lamp means positioned for directing light on the inner surface of said photoconductor between said toner applying means and said image transfer station.

3. In an electrophotostatic imaging machine having a photoconductor mounted for movement in a closed loop wherein said photoconductor includes a chargeable photosensitive layer and an image transmitting layer on an inner side of said photosensitive layer, means for electrostatically charging said photoconductor, and means for feeding copy medium past an image transfer station relative to the outer surface of said photoconductor, an improvement comprising:

means for imposing an image onto the inner surface of said electrostatically charged photoconductor; and toner applying and scavenging means including a plurality of magnetic brush means with at least one of said brush means biased for removing loose toner from said photoconductor and at least one other of said magnetic brush means biased for developing the image defined by selected discharge of said photoconductor.

4. An improved machine in accordance with claim 3 wherein said toner applying and scavenging means includes a plurality of said magnetic brush means biased for removing loose toner.

5. An improved machine in accordance with claim 3 wherein said photoconductor is arranged to initially engage at least one of said toner removal biased magnetic brush means before engagement with at least one of said image developing biased magnetic brush means.

6. In a xerographic machine having a closed-loop belt that has an image transmitting layer on the interior of the loop in underlying relation to an electrostatically chargeable photoconductor layer and with an arrangement for feeding copy medium past an image transfer station on the outer surface of the belt, the method comprising the steps of:

charging the photoconductor layer of the belt;

directing an image onto the belt inner surface for selectively discharging the photoconductor;

scavenging loose toner from the belt exterior surface;

applying toner concurrently with said scavenging step to the belt exterior surface at a common station with said scavenging step to develop the image defined by the selective photoconductor discharge;

discharging the belt; and transferring the toned image from the belt to a copy medium.

* * * * *